US005559529A

United States Patent [19]

Maher

[11] Patent Number: 5,559,529

[45] Date of Patent: Sep. 24, 1996

[54] DISCRETE MEDIA DISPLAY DEVICE AND METHOD FOR EFFICIENTLY DRAWING LINES ON SAME

[75] Inventor: Steven C. Maher, Cedar Rapids, Iowa

[73] Assignee: Rockwell International, Seal Beach, Calif.

[21] Appl. No.: 841,686

[22] Filed: Feb. 26, 1992

[51] Int. Cl.[6] ..... G09G 5/10

[52] U.S. Cl. ..... 345/136; 345/147; 395/143

[58] Field of Search ..... 340/728, 723, 340/744, 747, 703; 345/132, 133, 135, 136, 137, 138, 147, 149, 150, 152; 395/130, 131, 133, 141, 143

[56] References Cited

U.S. PATENT DOCUMENTS

| | | | |
|---|---|---|---|
| 4,612,540 | 9/1986 | Pratt | 340/744 |
| 4,704,605 | 11/1987 | Edelson | 340/728 |
| 4,873,515 | 10/1989 | Dickson et al. | 340/728 |
| 4,988,984 | 1/1991 | Gonzalez-Lopez | 340/728 |
| 5,132,674 | 7/1992 | Bottorf | 340/728 |

OTHER PUBLICATIONS

Publication by VanNostrand Reinhold of New York, New York in the *Flat Panel Displays And CRTs*, Section 1.6, pp. 18–21, 1985 entitled "Picture Element Or Pixel".

*Primary Examiner*—Richard Hjerpe
*Assistant Examiner*—Steve Saras
*Attorney, Agent, or Firm*—Gregory G. Williams; M. Lee Murrah; George A. Montanye

[57] ABSTRACT

An improved discrete media display apparatus and a method for quickly drawing high quality lines on discrete media displays where only pixels are rendered in the line drawing of a vector generator and then individual element intensities within a pixel are generated in response to predetermined pixel configuration and pixel distance and angle information from the desired line.

9 Claims, 3 Drawing Sheets

DISCRETE MEDIA DISPLAY DEVICE AND METHOD FOR EFFICIENTLY DRAWING LINES ON SAME

CROSS-REFERENCE TO RELATED APPLICATIONS

This application generally relates to the subject matter of co-pending application by S. A. Bottorf entitled "Method And Apparatus For Drawing High Quality Lines On Color Matrix Displays", filed on Jun. 6, 1989 and having Ser. No. 07/363,431 which is a File Wrapper Continuation of Ser. No. 07/113,033 filed on Oct. 22, 1987, which applications are incorporated herein by this reference.

FIELD OF THE INVENTION

This invention generally relates to displays and more particularly concerns discrete media displays and even more particularly relates to discrete media displays having high position resolution and image quality requirements, and even more particularly relates to efficient generation of individual element intensities thereby providing for enhanced image quality.

Presently, across the display industry, there is a significant effort underway to increase the image quality and position resolution of symbology upon discrete media displays. Typically, discrete media displays, such as color matrix displays, consist of a regular patterned array of separately addressable elements, with each element corresponding to one of the three preferred colors; red, green and blue. This element matrix is common to liquid crystal displays, thin film electro-luminescent displays, etc. Frequently, it is desirable to have a high information content display and in such applications the image quality and position resolution become increasingly important.

One type of matrix display that has been commonly used in the past is a delta matrix, where each pixel is treated much like a pixel in a CRT. During line drawing the independent separate color matrix elements are grouped into pixels, each having one red, one blue and one green element. This pixel or picture element arrangement is discussed in Section 1.6 on Pages 18–21 of *Flat Panel Displays And CRTs,* by Lawrence E. Tannis Jr., published by VanNostrand Reinhold of New York, New York which is incorporated herein by this reference.

While this pixel approach has been utilized extensively in the past it does have several serious drawbacks. One predominant drawback of such a design is that when a diagonal line is drawn across the display matrix, the line frequently appears jagged. Another problem with such a design is that the position resolution of any line drawn upon the matrix is limited by the pixel size. Additionally, the typical pixel approach does not allow computation of unique intensities of each element within the pixel, thereby reducing the intensity resolution of the display.

It has also been proposed in the above referenced patent application that the pixel approach be disregarded and that each filter element of a color liquid crystal display be addressed individually. This approach provides for increased spatial resolution, but it does require a significant increase in rendering requirements, which result in a slower overall display generating capability.

Consequently, there exists a need for improvement in discrete media displays, which provides for improved positional resolution and improved image quality while concomitantly providing for a relatively rapid display generation rate.

SUMMARY OF THE INVENTION

It is an object of the present invention to provide a discrete media display having an improved line quality.

It is a feature of the present invention to individually energize a plurality of elements, with varying intensities for each pixel to be displayed.

It is an advantage of the present invention to create an intensity distribution among the pixel which allows for smoother line image quality.

It is another object of the present invention to provide an increased antialiasing capability.

It is another feature of the present invention to vary the intensity of the elements within each pixel by reference to the predetermined configuration of the elements in the pixel and the relative distance and relative angle of a predetermined position within the pixel with respect to the desired line position.

It is another advantage of the present invention to provide increased position resolution while maintaining the throughput generally associated with addressing and rendering pixels only.

The present invention is designed to satisfy the aforementioned needs, produce the above described objects, include the previously stated features, and produce the earlier articulated advantages.

The present invention is an "non-individually rendered element" discrete media display in the sense that individual filter elements are not individually rendered by the vector generator, or the like. Instead, the lines are drawn by rendering each pixel and then generating individual element intensities within the pixel as a function of distance and angle of the pixel with respect to the desired line position and the predetermined configuration of the internal structure of the pixel.

Accordingly, the present invention includes a method and apparatus for drawing high quality lines on a discrete media display where a pixel is rendered by a vector generator, or the like, and subsequently individual intensities are determined for the elements within the pixel by reference to the predetermined configuration of the pixel and the location of the pixel with respect to the desired line position.

BRIEF DESCRIPTION OF THE DRAWINGS

The invention may be more fully understood by reading the following description of the preferred embodiment of the invention in conjunction with the appended drawings wherein.

DETAILED DESCRIPTION

Figure 1:
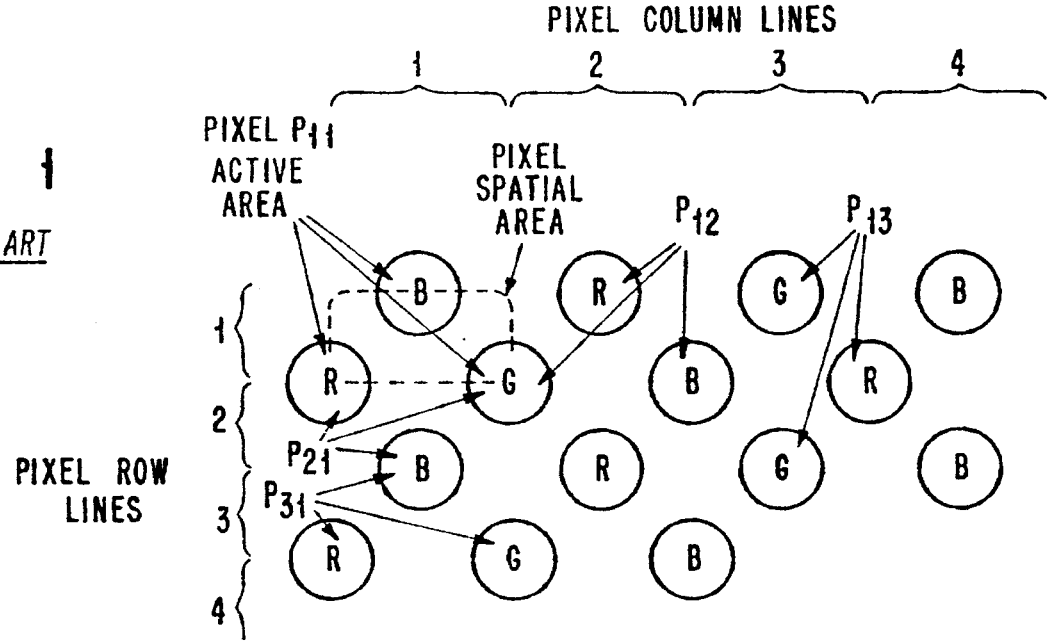
FIG 1 PRIOR ART
FIG. 1 is a schematic representation of a prior art display matrix which utilizes separate elements grouped into pixel groups.

Now referring to the drawings and more particularly to FIG. 1, there is shown a matrix from a prior art display which shows the grouping together of individual elements into pixel configurations. In such an arrangement, the display positional resolution is a function of pixel spatial dimensions. Display engineers have used this pixel approach and have typically considered the pixel to be the lowest resolvable spatial increment quantum and therefore have generated the lines in the characters by logically treating the pixels as the smallest element. In other words, the individual elements within the pixels were not provided with independent intensity values.

Figure 2:
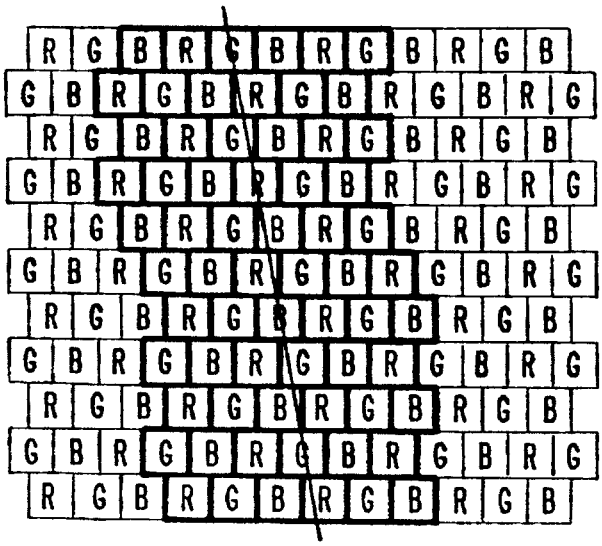
FIG 2 PRIOR ART
FIG. 2 is a schematic representation of a prior art delta type color matrix display where the diagonal line represents the desired position and orientation of a line to be drawn upon the matrix while the linear individual elements roughly centered about this line and outlined by a heavy line are represented as being individually activated and rendered.

Now referring to FIG. 2, there is shown a prior art delta type color matrix array which is shown being addressed by the method and apparatus of the above referenced patent application. The diagonal line represents the desired central position and orientation of a line drawn upon the display. The six linear elements roughly centered about each line segment and outlined in heavier lines are representative of the elements to be individually activated and rendered in order to draw any particular line segment. This particular method and apparatus has the drawback in that it requires that each individual element be individually rendered and addressed thereby significantly increasing the time necessary for rendering the total display array.

Figure 3:
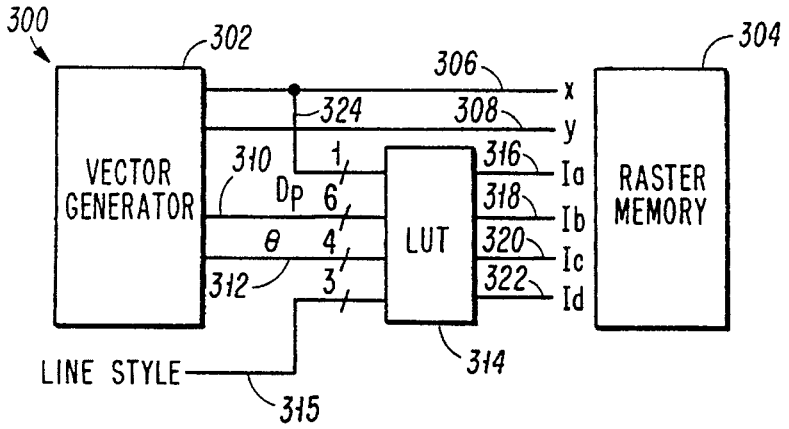
FIG. 3 is a schematic representation of the display device of the present invention including a vector generator, a look up table and an element memory array.

The invention can be more clearly understood by referring to FIG. 3, which is a schematic overview representation of the present invention generally designated 300 which includes a typical vector generator 302 and a common raster memory 304 or any other display memory. The output of the vector generator is the X coordinate 306 and Y coordinate 308 of the pixels comprising the desired line, the distance Dp 310 between the desired line and the pixel and the angle θ 312 together with a line style information signal 315. Also shown is a look up table (LUT) 314 which is used to generate the individual intensities Ia 316, Ib 318, Ic 320, and Id 322 for each individual element in the pixel in response to the distance Dp 310 and angle θ 312 of the pixel with respect to the desired line position. LUT 314 is preferably a pair of 16K ×8 proms which are common in the industry, or the like.

Also shown is X information input line 324 which provides X information to look up table 314 when delta triad grouping is used.

Figure 6:
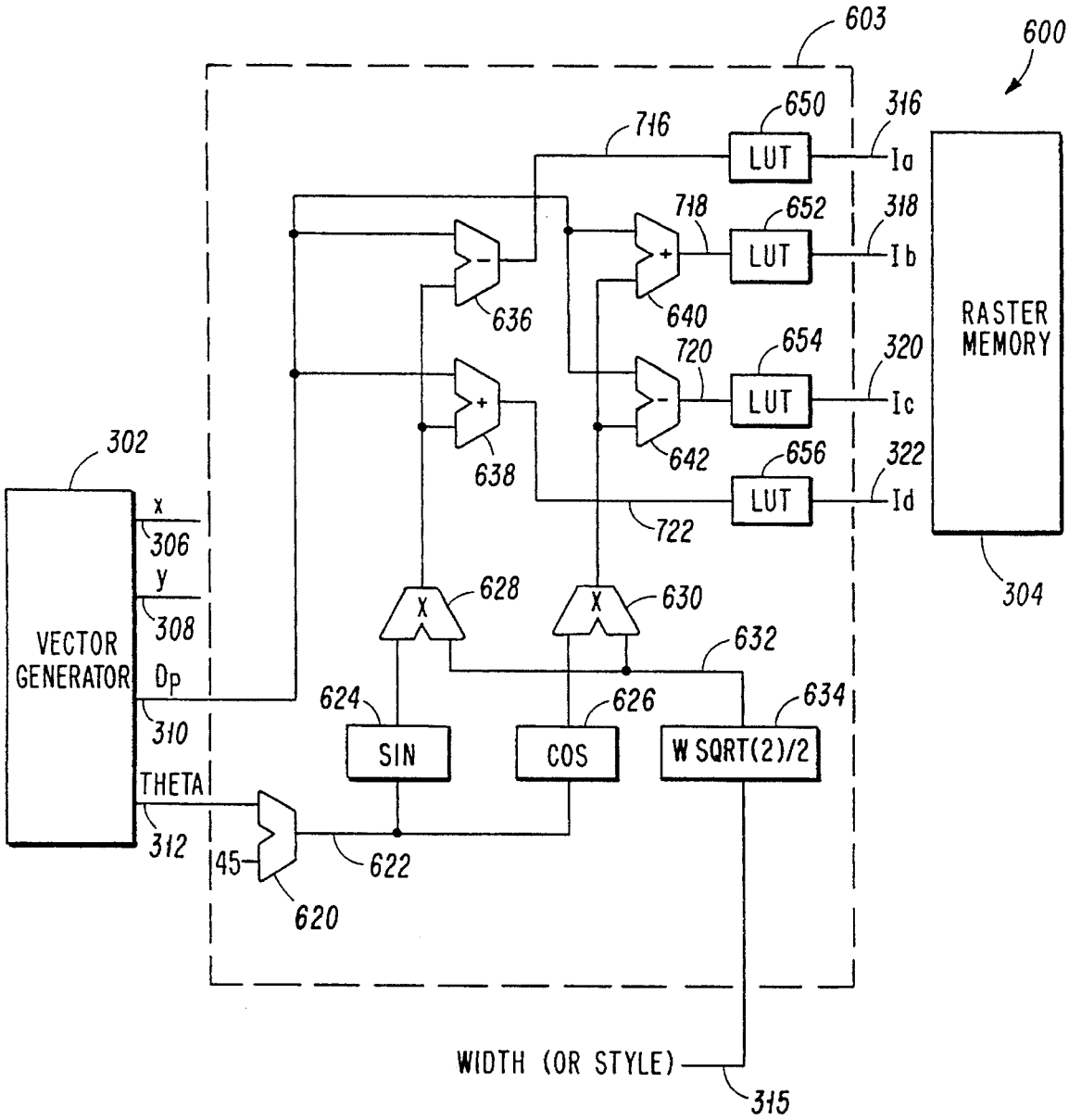
FIG. 6 is a schematic representation of a circuit of the present invention for a quad pixel arrangement.

The process of conversion in look up table 314 are described in more depth in relation to FIG. 6 and is also shown in the appendix, which is the software for the LUT 314 for a quad pixel.

Figure 4:
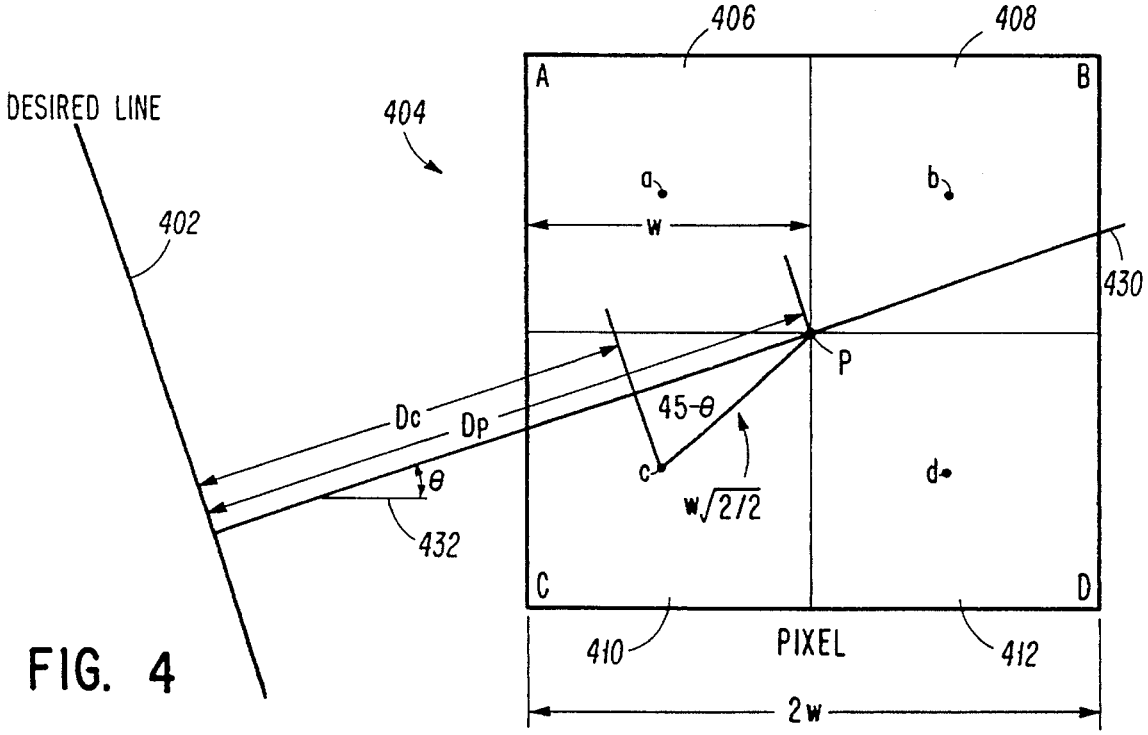
FIG. 4 is a schematic representation of the method of the present invention showing the trigonometric relationships between the individual elements within the pixel and the desired line.

Now referring to FIGS. 3 and 4, there is shown the method and apparatus of the present invention for drawing a desired line 402 with a pixel 404 having a width 2 W and a pixel central reference point P disposed therein, also having element A 406, element B 408, element C 410 and element D 412, therein with center points a, b, c, and d respectively. The distance Dp is provided by the vector generator 302 (FIG. 3) as is pixel reference angle θ 312, which is chosen to be the angle between the normal 430 to the desired line 402 and a predetermined pixel reference line 432. Lines other than the normal to the desired line and a reference line parallel to the bottom line of the pixel might be chosen as alternatives, those choices represented herein are believed to be preferred for simplicity and speed reasons. The perpendicular distance from the desired line to each center point may be calculated as follows:

$$Da=Dp-(w\sqrt{2}/2)\sin(45-\theta)$$

$$Db=Dp+(w\sqrt{2}/2)\cos(45-\theta)$$

$$Dc=Dp-(w\sqrt{2}/2)\cos(45-\theta)$$

$$Dc=Dp+(w\sqrt{2}/2)\sin(45-\theta)$$

End point antialiasing is also possible using this technique. In this case the direction from the end-point of the desired line to the pixel along with the distance from the end-point to the pixel are used to compute the element intensities, in a fashion analogous to the above discussed case for antialiased lines.

These examples use centrally located points P, a, b, c and d for simplicity and speed reasons, however it is contemplated that points P, a, b, c and d could be located elsewhere, depending upon the peculiar requirements of any display system, and the specific grouping and arrangement of elements into pixels.

Figure 5A:
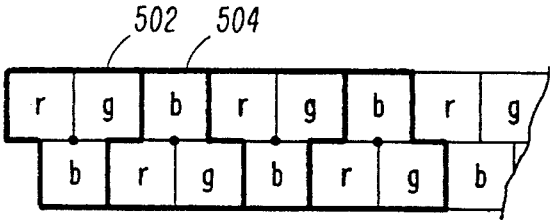
FIG. 5A is a representation of how a delta triad grouping may be addressed.
Figure 5B:
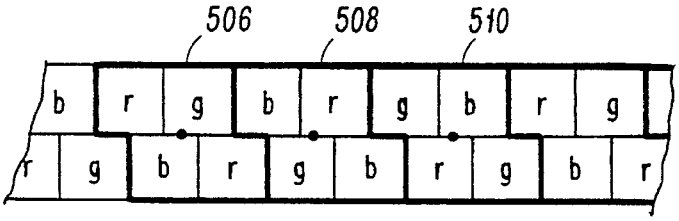
FIG. 5B is a representation of how a delta quad grouping may be addressed.

Similarly, while the previous example demonstrates a four element pixel in a quad relationship and assumes elements with a unity aspect ratio it is understood that elements with non-unity aspect ratios as well as pixels of non-rectangular shape may be used. In fact, the present invention may be used for any discrete media display having a fixed geometric relationship existing between the pixels and the elements contained therein. For example, FIGS. 5A and 5B shows how a delta LCD panel may be addressed as groups of 3 (triads) (5A) or groups of 4 (quads) (5B). Many other arrangements are possible.

In a situation such as the triads (5A), more than one distinct pixel arrangement is necessary, and it is necessary to use some bits of the pixel address (in this case, the least significant bit of the X address) to distinguish as to triad type. (See 306, FIG. 3 and FIG. 6).

The implementation of the method of this invention is most easily achieved by using a look up table on the output of a vector generator. This look up table must receive the distance and angle information from the vector generator. This information may be encoded in one of many possible forms as long as both distance and direction information may be derived from the encoding. The preferred precision for Dp and θ are six bits of Dp (three integer, three fractional), and four bits of θ to provide desirable results. The software code for the LUT 314 for a quad pixel is included in the appendix.

Now referring to FIG. 6, there is shown an alternate embodiment of the present invention generally designated 600 which includes a vector generator 303 and a raster or other display memory 304 and circuit 603. While it may be preferable to use a prom look up table to implement the present invention, it also is desirable in some situations to use a custom integrated circuit, which would perform the functions of the circuit 603. It must be understood that the custom integrated circuit may be divided into separate integrated circuits or combined with others depending on the requirements of any particular system. For example, the vector generator 302 and the circuit 603 might be combined on to a single custom integrated circuit.

FIG. 6 shows vector generator 602 outputting a X information line 306, a Y information line 308, a Dp information line 310 which corresponds to the distance from the desired line to a predetermined position in a particular pixel, and a θ information line 312 which corresponds to the angle between the normal of the desired line and a predetermined pixel reference line. Output from circuit 603 is an intensity line 316 for element A, intensity line 318 for element B, intensity line 320 for element C, and intensity line 322 for element D. The individual element intensities are derived from the individual element distances by utilizing any of numerous well known techniques and algorithms in the discrete media display area. The logic element array of circuit 603 accomplishes its results as follows: angle information is input on line 312 to first logic element 620 which outputs a value for (45−θ) on to line 622 which provides an input to logic elements 624 and 626 which perform the sin and cos functions respectively upon the value of 622. Outputs from logic elements 624 and 626 are supplied to the inputs of logic elements 628 and 630 respectively which each have an input 632 which represents the output of logic element 634 which is used to generate the value $W\sqrt{2}/2$ where W is a function of the line width or style provided on line 316.

Logic elements 628 and 630 multiply the $W\sqrt{2}/2$ times the sin and cos of 45−θ, respectively and each supply the product to a pair of logic elements. Logic element 628 provides its product to logic element 636 and logic element 638, while logic element 630 provides its product to logic element 640 and 642. Logic elements 636, 638, 640 and 642 perform the functions of adding or subtracting the products generated by 628 or 630 to the distance Dp and thereby generating distance 716, 718, 720 and 722 respectively, which are input to look up tables 650, 652, 654 and 656 respectively, which output intensities 316, 318, 320, and 322 respectively.

While particular embodiments of the present invention have been shown and described, it should be clear that changes and modifications may be made to such embodiments without departing from the true scope and spirit of the invention. It is intended that the appended claims cover all such changes and modifications.

Appendix

```
/*=================================================================================*/
/*                                                                                 */
/*  profile.c                                                                      */
/*                                                                                 */
/*  This program contains the code to generate the intensities for four elements   */
/*  of a quad panel using the "clump addressing" technique.  Input to the program  */
/*  consists of desired line width.  Note that lines of several widths may be      */
/*  accomodated.  The output of this program consists of the contents of two       */
/*  16K x 8 proms.                                                                 */
/*                                                                                 */
/*                                  u1                                             */
/*                          ----------------------                                 */
/*                          |                    |                                 */
/*  end/mid  <   --------| a13                |                                 */
/*                          |                    |                                 */
/*            /  --------| a12            d7 |--------  \                       */
/*            |             |                    |          |                       */
/*  profile  <   --------| a11            d6 |--------  |                       */
/*            |             |                    |          > intensity_a           */
/*            \  --------| a10            d5 |--------  |                       */
/*                          |                    |          |                       */
/*            /  --------| a9             d4 |--------  /                       */
/*            |             |                    |                                 */
/*            |  --------| a8             d3 |--------  \                       */
/*            |             |                    |          |                       */
/*            |  --------| a7             d2 |--------  |                       */
/*  distance <             |                    |          > intensity_b           */
/*            |  --------| a6             d1 |--------  |                       */
/*            |             |                    |          |                       */
/*            |  --------| a5             d0 |--------  /                       */
/*            |             |                    |                                 */
/*            \  --------| a4                 |                                 */
/*                          |                    |                                 */
/*            /  --------| a3                 |                                 */
/*            |             |                    |                                 */
/*            |  --------| a2                 |                                 */
/*  angle    <             |                    |                                 */
/*            |  --------| a1                 |                                 */
/*            |             |                    |                                 */
/*            \  --------| a0                 |                                 */
/*                          |                    |                                 */
/*                          ----------------------                                 */
/*                                                                                 */
/*                                                                                 */
/*                                  u2                                             */
/*                          ----------------------                                 */
/*                          |                    |                                 */
/*  end/mid  <   --------| a13                |                                 */
/*                          |                    |                                 */
/*            /  --------| a12            d7 |--------  \                       */
/*            |             |                    |          |                       */
/*  profile  <   --------| a11            d6 |--------  |                       */
/*            |             |                    |          > intensity_c           */
/*            \  --------| a10            d5 |--------  |                       */
/*                          |                    |          |                       */
/*            /  --------| a9             d4 |--------  /                       */
/*            |             |                    |                                 */
/*            |  --------| a8             d3 |--------  \                       */
/*            |             |                    |          |                       */
/*            |  --------| a7             d2 |--------  |                       */
/*  distance <             |                    |          > intensity_d           */
/*            |  --------| a6             d1 |--------  |                       */
/*            |             |                    |          |                       */
/*            |  --------| a5             d0 |--------  /                       */
/*            |             |                    |                                 */
/*            \  --------| a4                 |                                 */
/*                          |                    |                                 */
/*            /  --------| a3                 |                                 */
/*            |             |                    |                                 */
/*            |  --------| a2                 |                                 */
/*  angle    <             |                    |                                 */
/*            |  --------| a1                 |                                 */
/*            |             |                    |                                 */
/*            \  --------| a0                 |                                 */
```

```
/*                        |                    |                                  */
/*                         ---------------------                                  */
/*                                                                                */
/*                                                                                */
/*                                                                                */
/*   signal description (inputs)                                                  */
/*   ---------------------------                                                  */
/*                                                                                */
/*     end/mid  -  indicates whether a clump lies along a line or within the lines' */
/*                 circular endcap                                                */
/*                                                                                */
/*     profile  -  selects one of 8 line profiles                                 */
/*                                                                                */
/*     distance -  the perpindicular distance from the clump to the line, or the  */
/*                 radial distance from the clump to the endpoint  (three bits of */
/*                 integer distance, three bits of fractional distance)           */
/*                                                                                */
/*     angle    -  the angle between the horizontal x-axis, and the perpindicular */
/*                 between the line and the clump (or the angle between the       */
/*                 horizontal x-axis and the line connecting the endpoint to the  */
/*                 clump)                                                         */
/*                                                                                */
/*   signal description (outputs)                                                 */
/*   ----------------------------                                                 */
/*     intensity_a  -  the intensity of the "a" element of the quad               */
/*                                                                                */
/*     intensity_b  -  the intensity of the "b" element of the quad               */
/*                                                                                */
/*     intensity_c  -  the intensity of the "c" element of the quad               */
/*                                                                                */
/*     intensity_d  -  the intensity of the "d" element of the quad               */
/*                                                                                */
/*                                                                                */
/*                              a "clump"                                         */
/*         -------------------------------------------------------                */
/*        |                         |                         |                   */
/*        |                         |                         |                   */
/*        |                         |                         |                   */
/*        |                         |                         |                   */
/*        |                         |                         |                   */
/*        |                         |                         |                   */
/*        |            a            |            b            |                   */
/*        |           /             |                         |                   */
/*        |          /              |                         |                   */
/*        |         /               |                         |                   */
/*        |     element             |                         |                   */
/*        |     center              |                         |                   */
/*        |-------------------------X-------------------------|                   */
/*        |                        /|                         |                   */
/*        |                       / |                         |                   */
/*        |                      /  |                         |                   */
/*        |                     /   |                         |                   */
/*        |                clump    |                         |                   */
/*        |            c     center |            d            |                   */
/*        |                         |                         |                   */
/*        |                         |                         |                   */
/*        |                         |                         |                   */
/*        |                         |                         |                   */
/*        |                         |                         |                   */
/*        |                         |                         |                   */
/*         -------------------------------------------------------                */
/*                                                                                */
/*                                                                                */
/*   It is assumed that elements are square and have dimensions of 1 "unit" on a  */
/*   side.                                                                        */
/*                                                                                */
/*================================================================================*/

#include <stdio.h>
#include <math.h>

/*------ function to convert an argument in degrees to radians ----------------------*/

float deg2rad(float a) {return(0.017453292 * a) ;}
```

```
/*------ main ------------------------------------------------------------------------*/

main(int argc, char *argv[]) {
  FILE *params_file, *ab_file, *cd_file ;
  int profile, i, emf, distance, angle ;
  int ia, ib, ic, id ;
  long int addr ;
  float w, k, x, sum, t, max, p[4][500] ;
  float d, theta, da, db, dc, dd ;

  /*---- open parameters file (contains line widths, k-factors, etc -----------------*/

  if((params_file = fopen("params.pro", "rt")) == NULL) {
    fprintf(stderr, "Error:  unable to open file  params.pro\n") ;
    return(1) ;
  }

  /*---- open output files, place file delimiters at beginning ----------------------*/

  ab_file = fopen("ab.bin", "wb") ;
  cd_file = fopen("cd.bin", "wb") ;

  fputc(0xFF, ab_file) ;
  fputc(0xFF, cd_file) ;

  /*---- read in the parameters for each line, compute profile ----------------------*/

  for(profile=0; profile<=3; profile++) {
    fscanf(params_file, "%f %f %c", &w, &k) ;

    /*------- compute line profile ---------------------------------------------------*/
    /*                                                                                */
    /*   the line profile is the convolution of an "ideal" box profile with a         */
    /*   gaussian of the form exp(-k^2 * x^2), yielding a profile of the shape:       */
    /*                                                                                */
    /*                                                                                */
    /*                    intensity                                                   */
    /*                       |______                                                  */
    /*                       |      \                                                 */
    /*                       |       |                                                */
    /*                       |       |                                                */
    /*                       |        \_______                                        */
    /*                      -|---------------- distance from                          */
    /*                       |       |         center of line                         */
    /*                       0      w/2                                               */
    /*--------------------------------------------------------------------------------*/

    for(i=0; i<500; i++) {
      x = (float)i * 0.1 ;
      sum = 0.0 ;
      for(t=-w/2.0; t<=w/2.0; t+=0.1)
        sum += exp(-k * k * (x + t) * (x + t)) ;
      if(i == 0) max = sum ;
      p[profile][i] = sum / max ;
    }
  }

  /*------------ compute rom contents ------------------------------------------------*/

  for(addr=0; addr<16384; addr++) {
    emf = (addr >> 13) & 1 ;
    profile = (addr >> 10) & 7 ;
    distance = (addr >> 4) & 63 ;
    angle = addr & 15 ;

    /*---------- convert distance to float ----------------------------------------*/

    d = (float)distance / 8.0 ;

    /*---------- convert angle to radians -----------------------------------------*/

    theta = 6.283185307 * (float)angle / 16.0 ;
```

```
    if(emf == 0) {

      /*-------- along midsection of line ----------------------------------------*/

      da = d - (sqrt(2.0) / 2.0) * sin(theta) ;
      db = d + (sqrt(2.0) / 2.0) * cos(theta) ;
      dc = d - (sqrt(2.0) / 2.0) * cos(theta) ;
      dd = d + (sqrt(2.0) / 2.0) * sin(theta) ;
    }
    else {

      /*-------- in endcap of line ------------------------------------------------*/

      if((theta <= 135.0) || (theta >= 315.0))
        da = d * d + (w * w / sqrt(2.0)) - d * w * sqrt(2.0) * cos(deg2rad(theta + 45.0)) ;
      else
        da = d * d + (w * w / sqrt(2.0)) - d * w * sqrt(2.0) * cos(deg2rad(315.0 - theta)) ;

      if((theta >= 45.0) && (theta <= 225.0))
        db = d * d + (w * w / sqrt(2.0)) - d * w * sqrt(2.0) * cos(deg2rad(225.0 - theta)) ;
      else
        db = d * d + (w * w / sqrt(2.0)) - d * w * sqrt(2.0) * cos(deg2rad(theta - 225.0)) ;

      if((theta >= 45.0) && (theta <= 225.0))
        dc = d * d + (w * w / sqrt(2.0)) - d * w * sqrt(2.0) * cos(deg2rad(theta - 45.0)) ;
      else
        dc = d * d + (w * w / sqrt(2.0)) - d * w * sqrt(2.0) * cos(deg2rad(315.0 - theta)) ;

      if((theta <= 135.0) || (theta >= 315.0))
        dd = d * d + (w * w / sqrt(2.0)) - d * w * sqrt(2.0) * cos(deg2rad(135.0 - theta)) ;
      else
        dd = d * d + (w * w / sqrt(2.0)) - d * w * sqrt(2.0) * cos(deg2rad(theta - 135.0)) ;
    }

    /*---------- compute intensities ----------------------------------------------*/

    ia = (int)(15.0 * p[profile][(int)(da / 0.1)] + 0.5) ;
    ib = (int)(15.0 * p[profile][(int)(db / 0.1)] + 0.5) ;
    ic = (int)(15.0 * p[profile][(int)(dc / 0.1)] + 0.5) ;
    id = (int)(15.0 * p[profile][(int)(dd / 0.1)] + 0.5) ;

    /*---------- write intensities to files ---------------------------------------*/

    fputc((ia << 4) | ib, ab_file) ;
    fputc((ic << 4) | id, cd_file) ;
  }

  /*------------ close files ------------------------------------------------------*/

  fclose(params_file) ;
  fclose(ab_file) ;
  fclose(cd_file) ;

  return(0) ;
}
```

I claim:

1. An improved display apparatus comprising:

an array of individually addressable display elements;

a vector generator for rendering lines by addressing a plurality of pixels, where each pixel includes a plurality of elements arranged in a predetermined pixel pattern, and generating signals relating to a first pixel, where said signals include a pixel distance signal, representative of the distance from said first pixel to a predetermined line, and an orientation signal, representative of the orientation of the first pixel with respect to the predetermined line;

a memory, coupled with said array, for storing individual intensity signals for each of said elements;

means, coupled with said vector generator and said memory, for generating an element distance signal for each element in said first pixel, by modifying said pixel distance signal in response to said orientation signal and as a function of said predetermined pixel pattern, and further for generating an element intensity signal for each element in said first pixel in response to said element distance signals; and, WHEREBY, the display apparatus is improved when individual intensities are generated for each element in a pixel, while the vector generator generates signals relating to pixels.

2. A display apparatus of claim 1 wherein said array of display elements comprises a matrix array of color liquid crystal filter elements.

3. A display apparatus of claim 1 wherein said array of display elements comprises a thin film electroluminesent matrix display.

4. A display apparatus of claim 1 wherein said array of display elements is a plasma display matrix.

5. A display apparatus of claim 1 wherein said means for generating an element distance signal comprises a programmable read only memory look up table.

6. A display apparatus of claim 2 wherein said means for generating an element distance signal comprises a programmable read only memory look up table.

7. A display apparatus of claim 1 wherein said means for generating an element distance signal comprises an integrated circuit using a logic element array to perform the generation of element distance signals in accordance with the formula $Da=Dp-w\sqrt{2}/2 \sin(45-\theta)$ where Da is the distance to element a and Dp is the distance to a pixel central point, w is the width of element a and $\theta$ is an angle between a normal to the predetermined line and a predetermined linear reference mark.

8. An improved display apparatus comprising:

an array of individually addressable display elements;

a vector generator for generating a pixel distance signal which corresponds to the perpendicular distance from a predetermined line to a first pixel, which includes a plurality of of display elements grouped in a predetermined pattern, and further for generating an angular signal which is representative of an angle between the normal to the predetermined line and a predetermined linear reference mark;

a memory, coupled with said array, for storing individual intensities for each element; and, a programmable read only memory, coupled with said vector generator and said memory, for receiving said pixel distance signal and said angular signal and generating in response thereto an element distance signal for each element in said first pixel and further generating an intensity signal for each element distance signal that is generated.

9. A method for drawing lines on a display device comprising the steps of:

providing a plurality of discrete display elements, each having a discrete address and a predetermined element reference point therein;

said plurality of elements being configured, in a predetermined fashion, into a plurality of pixels, with each pixel having a predetermined pixel reference point therein, said reference point having a predetermined geometric relationship with respect to a plurality of element reference points;

said plurality of pixels each having a predetermined pixel reference line associated therewith;

selecting from said plurality of pixels a first pixel or addressing for the purpose of drawing a predetermined line;

generating a distance value corresponding to the perpendicular distance from said predetermined line to a first of said predetermined pixel reference points;

generating an angular value representative of an angle formed by a normal to said predetermine line and said predetermined pixel reference line for said first pixel;

generating distance value for a plurality of said elements based upon said pixel distance value and said angular value and said predetermined geometric relationships; and, generating intensity values in response to said element distance values.

* * * * *